US007007802B1

(12) United States Patent
Moorman et al.

(10) Patent No.: US 7,007,802 B1
(45) Date of Patent: Mar. 7, 2006

(54) PRODUCE CARRYING TRAYS AND METHOD OF COOLING PRODUCE IN A FIVE-DOWN CONFIGURATION

(75) Inventors: Stephen E. Moorman, Madera, CA (US); Philip W. Weideman, Fresno, CA (US)

(73) Assignee: Georgia-Pacific Corporation, Atlanta, GA (US)

( * ) Notice: Subject to any disclaimer, the term of this patent is extended or adjusted under 35 U.S.C. 154(b) by 10 days.

(21) Appl. No.: 10/231,379

(22) Filed: Aug. 30, 2002

(51) Int. Cl.
*B65D 81/18* (2006.01)

(52) U.S. Cl. ..... 206/504; 206/521.1; 206/386; 220/676; 229/120

(58) Field of Classification Search ..... 206/503, 206/504, 521.1, 386, 597, 600; 220/661, 220/676; 229/120.1, 120; 426/106
See application file for complete search history.

(56) References Cited

U.S. PATENT DOCUMENTS

| | | | | |
|---|---|---|---|---|
| 4,105,117 | A * | 8/1978 | Atkin et al. | 206/501 |
| 4,175,691 | A * | 11/1979 | Cornell et al. | 206/509 |
| 4,513,907 | A | 4/1985 | Grosshuesch | |
| 4,597,503 | A * | 7/1986 | Lates | 220/676 |
| 4,946,093 | A * | 8/1990 | Moorman | 229/125.19 |
| 5,121,877 | A * | 6/1992 | Bodary et al. | 229/120 |
| 5,429,296 | A | 7/1995 | Southwell et al. | |
| 5,458,283 | A | 10/1995 | Southwell et al. | |
| 5,706,662 | A | 1/1998 | Van | |
| 5,727,711 | A | 3/1998 | Emond et al. | |
| 5,738,890 | A | 4/1998 | Cadiente et al. | |
| 5,945,147 | A * | 8/1999 | Borchard | 426/393 |
| 6,007,854 | A | 12/1999 | Cadiente et al. | |
| 6,074,676 | A | 6/2000 | Cadiente et al. | |
| 6,286,753 | B1 | 9/2001 | Jackson et al. | |
| 6,302,323 | B1 | 10/2001 | Southwell | |
| 2003/0198714 | A1 * | 10/2003 | Cadiente et al. | 426/106 |

* cited by examiner

*Primary Examiner*—Mickey Yu
*Assistant Examiner*—Jerrold Johnson

(57) ABSTRACT

A method and apparatus for cooling produce contained in ventilated trays arranged in a five-down configuration on a pallet. The ventilated trays according to the present invention have openings that correspond to fluid passageways in contained clamshells in order to efficiently and effectively channel cooling air into the clamshells and over the contained produce. The present invention creates direct airflow channels to the produce that cause an optimal amount of the forced air to enter and flow over the produce within the produce carrying containers and not around the produce carrying containers as can occur with conventional six-down configurations. As a result, more air enters the produce carrying containers, more passes over the produce and more produce is effectively cooled.

13 Claims, 8 Drawing Sheets

PRODUCE CARRYING TRAYS AND METHOD OF COOLING PRODUCE IN A FIVE-DOWN CONFIGURATION

The present invention relates to a method and apparatus for cooling produce contained in shipping/cooling trays carried on shipping pallets, more specifically, the present invention relates to a method and apparatus for cooling produce contained in shipping/cooling trays that are arranged on a pallet in a five-down configuration.

BACKGROUND OF THE INVENTION

Many fresh produce products are harvested and packaged in the field. These produce products include, but are not limited to, berries, such as strawberries, grapes, mushrooms, radishes, tomatoes, including cherry tomatoes, broccoli florets, lightweight tree fruit, and other fruits and vegetables. Many of these produce items require substantial post-harvest cooling in order to enable shipping over long distances and to prolong their shelf life.

In an attempt to provide some cooling to the packaged produce, the harvested fresh produce is typically packed into small, ventilated plastic containers that are ultimately purchased by the end consumer. These ventilated containers are commonly referred to as "clamshells". Eight of these small, ventilated containers are placed into larger shipping trays that, in turn, are stacked on pallets for shipping. The conventional shipping trays can each include a bottom wall, a pair of opposed sidewalls, and a pair of opposed endwalls. The endwalls of these shipping trays commonly have a recessed portion along their length that permits the cooling air to pass into the ventilated containers. These conventional shipping trays have a length of twenty inches and a width of sixteen inches.

The conventional shipping trays are loaded onto the pallet in a "six-down" configuration. In the six-down configuration, a layer of the shipping trays is formed on the pallet by positioning six of the shipping trays so that their longitudinal axes extend in parallel directions and their recessed endwalls extend in parallel planes (See FIG. 11). These parallel endwall planes extend perpendicular to the directions that the sidewalls extend. The shipping trays are typically arranged on the pallet in multiple stacked layers until a predetermined number of shipping trays, such as forty-eight, is achieved. The most common pallet used in the produce industry is the forty-inch by forty-eight inch wooden pallet, and the vast majority of produce handling, storage and shipping equipment is designed around this sized pallet.

After the stacked shipping trays are loaded onto their respective pallet, the loaded pallet is moved to a forced air cooling chamber to cool and/or store the fresh produce. In the air cooling chamber, the pallets are arranged in rows against a wall that includes a vacuum fan. The rows are spaced apart and a canvas sheet is draped over the rows and the opposing end of the chamber to create an airflow channel. When the fan is turned on, it draws ambient cold air from the room through the vent openings in the trays carrying the produce. Typically, the room temperature is maintained at 32 degrees Fahrenheit and the target temperature for the produce is about 36.5 degrees Fahrenheit.

During the cooling process, the ambient cooling air arrives within each shipping tray by entering through one of its respective recessed endwalls. The cooling air then enters the individual containers carried by the tray in an attempt to cool the produce stored therein. As the air cools the produce, it picks up heat from the produce. The warmed air is eventually exhausted from the shipping tray through the opposite recessed endwall. After cooling the fresh produce in the shipping containers, the shipping containers are transported to grocery stores and fresh produce markets, where the fresh produce is sold to consumers.

The orientation and arrangement of the conventional six-down shipping tray configurations does not permit multi-directional cooling of the stored produce. As a result, the arrangement of pallets is limited. Additionally, the amount of cooling air entering the shipping trays may also be limited, thereby effecting the survival of the produce.

SUMMARY OF THE INVENTION

An aspect of the present invention relates to an apparatus that permits produce trays to be arranged in a "five-down" configuration on a pallet so that the produce is effectively and efficiently cooled during storage and transportation to the location where the produce will be sold to consumers. Another aspect of the present invention relates to a method of cooling produce by arranging ventilated trays on a pallet in a five-down configuration.

The ventilated trays according to the present invention have openings that correspond to the openings and gaps in the contained clamshells to channel cooling air into the clamshells and over the contained produce. The cooling airflow over the produce according to the present invention is such that the cooling rate achieved by using the ventilated tray is substantially equal to that of the trays arranged in the six-down configuration. The present invention creates direct airflow channels that cause an optimal amount of the forced air to enter and flow over the produce within the produce carrying containers and not around the produce carrying containers as can occur with the six-down configuration. As a result, more air enters the produce carrying containers, more passes over the produce and more produce is effectively cooled.

An aspect of the present invention relates to a shipping tray for receiving produce carrying containers. The shipping tray comprises a bottom and a plurality of walls extending from the bottom. Each wall extends at an angle to an adjacent one of the walls. Each wall also includes a plurality of ventilation openings sized and configured to cooperate with openings in the produce carrying container so as to allow cooling fluid to pass through the walls and into the containers when the containers are positioned within the shipping tray.

Another aspect of the present invention relates to a tray for being arranged in a five down configuration on a pallet. The tray comprises first and second walls extending at angles to each other. The first wall includes a plurality of ventilation openings for aligning with fluid passages in produce carrying containers that are positionable within the tray. The second wall includes a plurality of ventilation openings for aligning with the fluid passages in the produce carrying containers so that fluid can pass through both walls of the tray and the produce carrying containers when said tray is positioned on the pallet.

A further aspect of the present invention also includes a method of cooling produce. The method comprises the steps of positioning a plurality of produce carrying trays on a pallet in a five-down configuration and placing the trays into a cooling chamber. Each of the produce carrying trays includes a first wall with ventilation openings that extends at an angle to a second wall that also includes ventilation openings. The method also includes the step of introducing a cooling fluid into a plurality of the produce carrying trays arranged in the five-down configuration through the ventilation openings in their respective first walls and into the remaining produce carrying trays arranged in the five-down configuration through ventilation openings in their respective second walls.

DETAILED DESCRIPTION OF THE INVENTION

Figure 1:
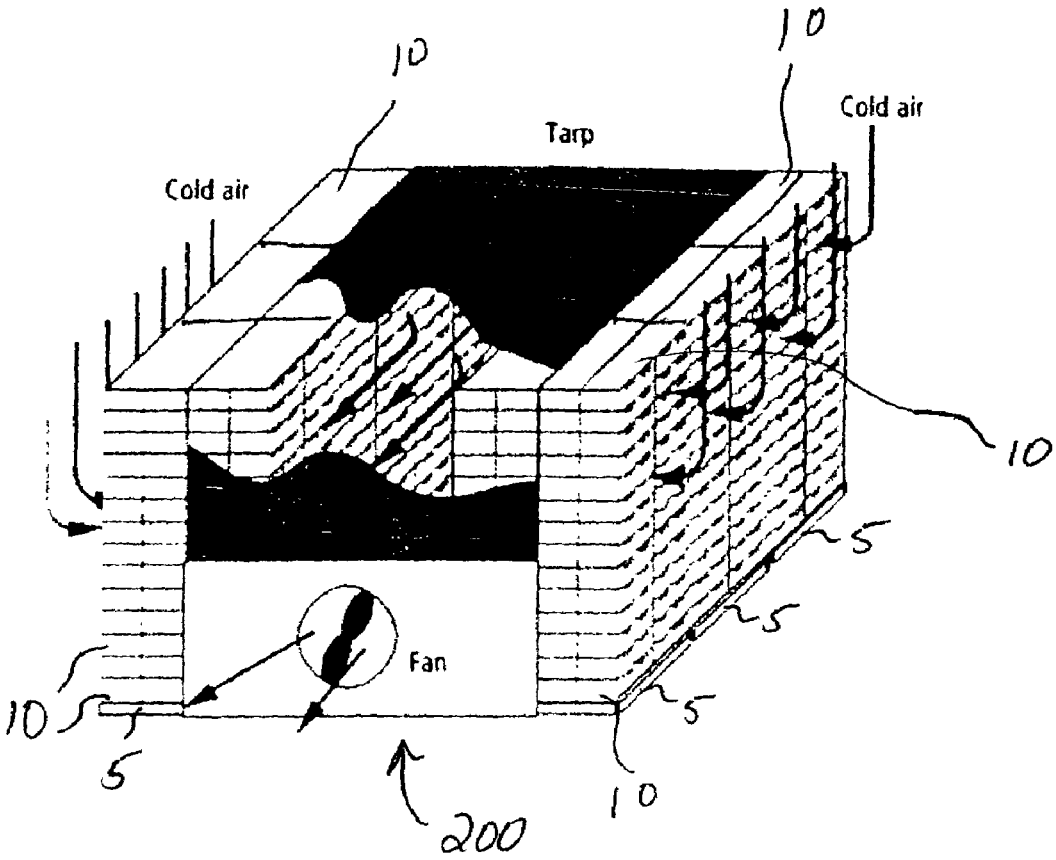
FIG. 1 illustrates a cooling chamber/room including a plurality of shipping pallets loaded with ventilated shipping trays in five-down configurations according to the present invention.
Figure 3:
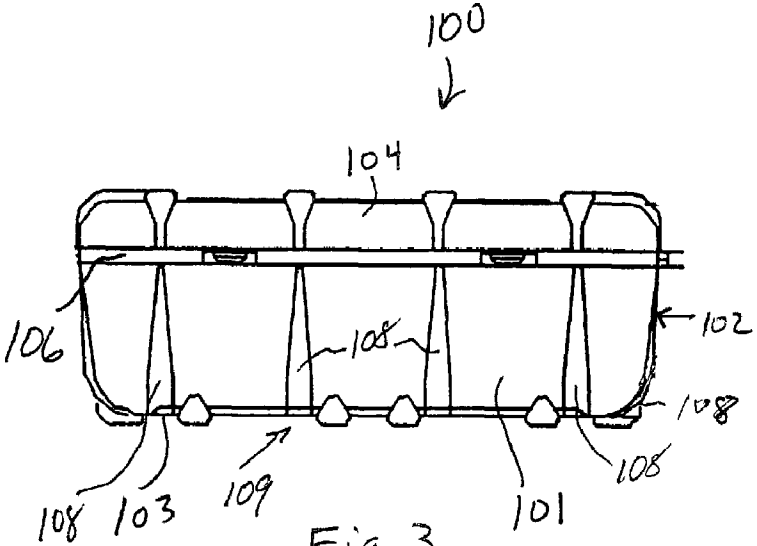
FIG. 3 is a side view of the container of FIG. 2.
Figure 2:
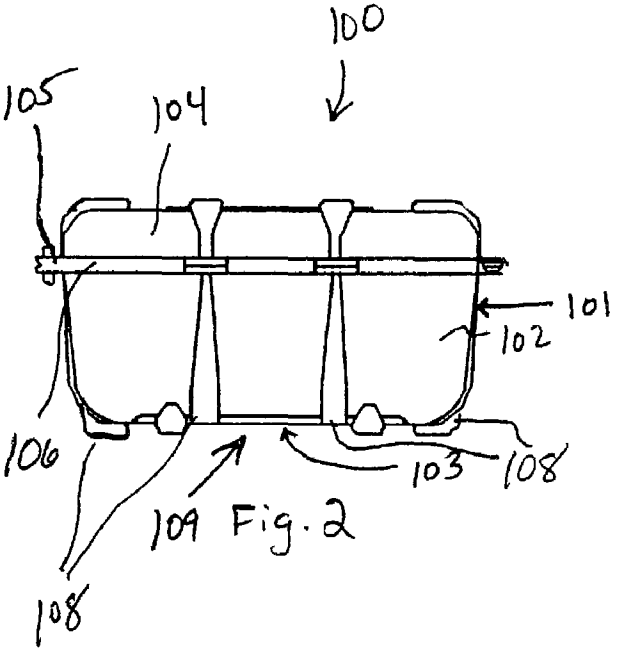
FIG. 2 is an end view of a ventilated produce container that is positioned within the ventilated trays illustrated in FIG. 1.
Figure 4:
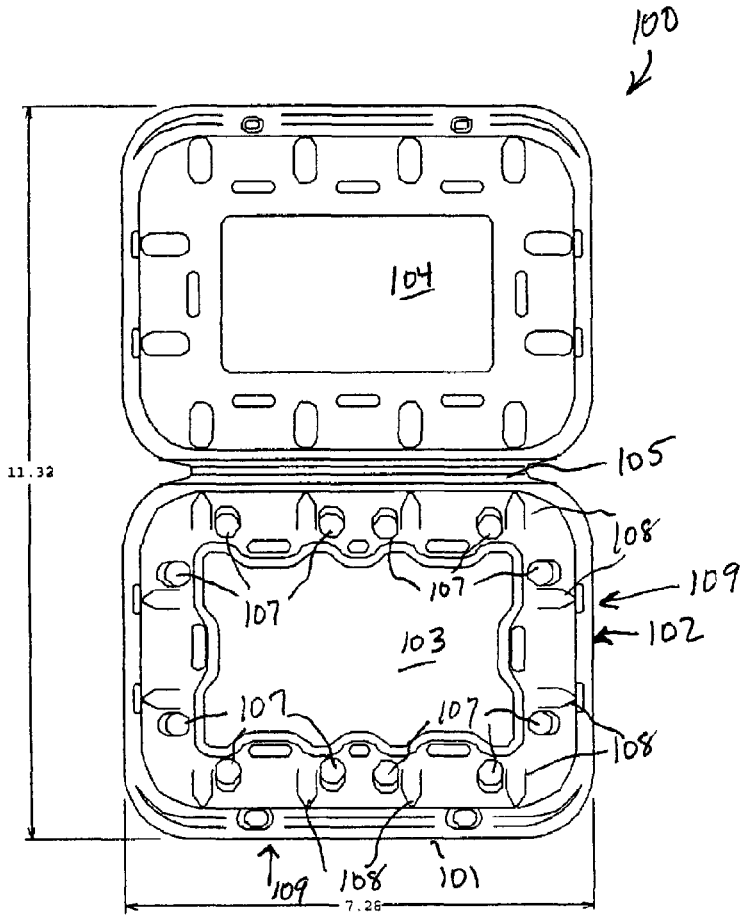
FIG. 4 is top plan view of the container of FIG. 2 with a hinged cover open.
Figure 5:
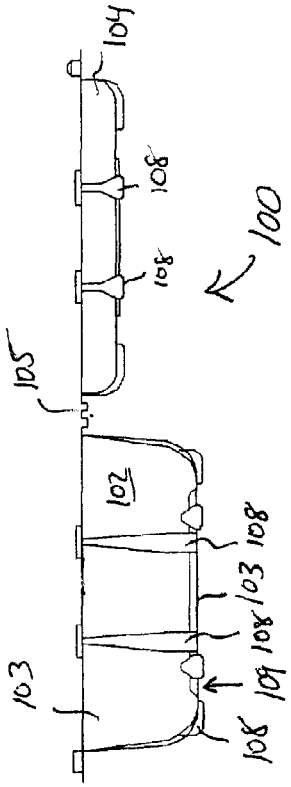
FIG. 5 is a side view of the container of FIG. 2 with the hinged cover open.

As shown in FIG. 1, the present invention includes ventilated carrying/shipping trays 10 having a plurality of openings and recesses that cooperate with openings in individual produce carrying containers 100 (FIG. 2) that are positioned within the ventilated trays to provide optimum cooling fluid flow around the contained produce. The openings of the ventilated trays 10 are aligned with openings in the containers 100 so that cooling fluids, such as air, enter the individual packages 100 and flow over the contained produce to effectively and efficiently cool the produce between the time that it is packaged and the time that it is sold to the consumer. As discussed below, the ventilated trays 10 are carried on conventional forty by forty-eight inch shipping pallets 5 in a "five-down" configuration. The shipping pallets 5 can be formed of wood, plastic or other known materials.

As shown in FIGS. 2–5, each produce carrying container 100 include a plurality of sidewalls 101, endwalls 102, a bottom surface 103 and a hinged cover 104 that form an interior, produce carrying region. The cover 104 is secured to one of the sidewalls 101 along its length by a hinge 105 so as to form a unitary, one-piece container. The hinge 105 can be continuous or include spaced openings. The dimensions of the container 100, such as height, can change depending on the carried produce. For example, in a preferred embodiment that can be used for carrying produce such as strawberries, the container 100 has a height extending from its lowest surface to its uppermost surface of between about 2.25 inches and 3.0 inches, preferably about 2.72 inches. The container 100 also has a length of between about 6.5 and 7.0 inches, preferably about 6.72 inches, and a width of between about 4.50 and 5.0 inches, preferably about 4.86 inches.

In another preferred embodiment of the container 100 that can be used for carrying produce such as grapes, the container 100 has a height of between about 4.0 inches and 4.50 inches, preferably about 4.22 inches. The container 100 also has a length of between about 6.50 and 7.0 inches, preferably about 6.72 inches, and a width of between about 4.50 and 5.0 inches, preferably about 4.86 inches.

The interior, produce carrying region is open to the exterior via multiple fluid passages. These fluid passages include a horizontal ventilation gap 106 formed between the hinged cover 104 and the sidewalls 101, endwalls 102 of the container 100. The gap 106 extends around at least three or more sides of the container 100 and has a vertical height of between about 0.05 and 0.30 inch. In a preferred embodiment, the height of the gap 106 is about 0.19 inch. The fluid passages also include ventilation openings 107 formed in the bottom surface 103. In a preferred embodiment, the container 100 includes twelve ventilated openings 107 positioned proximate support pillars 108. These support pillars 108 allow forced airflow and vacuum turbulence of the airflow through the bottom surface 103 and upward through the produce carried by the container 100. In a preferred embodiment, the pillars 108 include small projections or buttons on the bottom surface 103 of the container 100 that support the container above a surface, such as the inner bottom surface of the tray 10 and create a fluid channel 109 along the bottom of the container 100 so that cooling fluid can travel below the bottom surface 103 of the container 100 and enter the container 100 through the openings 107. The cooling air can experience either or both laminar and turbulent flow within the containers 100. In one embodiment, the cooling air experiences turbulent flow around the contained produce within the containers 100. These containers 100 are available from Intec Alliance under the name GENESYS. As discussed below, eight containers 100 are typically placed within each ventilated tray 10.

Certain embodiments of the container 100 may not include a ventilation gap 106. One such embodiment is discussed above for carrying grapes. In this embodiment, the endwalls 101 and sidewalls 102 will include vertically oriented ventilation slots. These slots operate in a similar manner to the ventilation gap 106. Specifically, they contribute to the efficient introduction of cooling air into the container 100 and the efficient removal of warmed air from the container 100.

Figure 6:
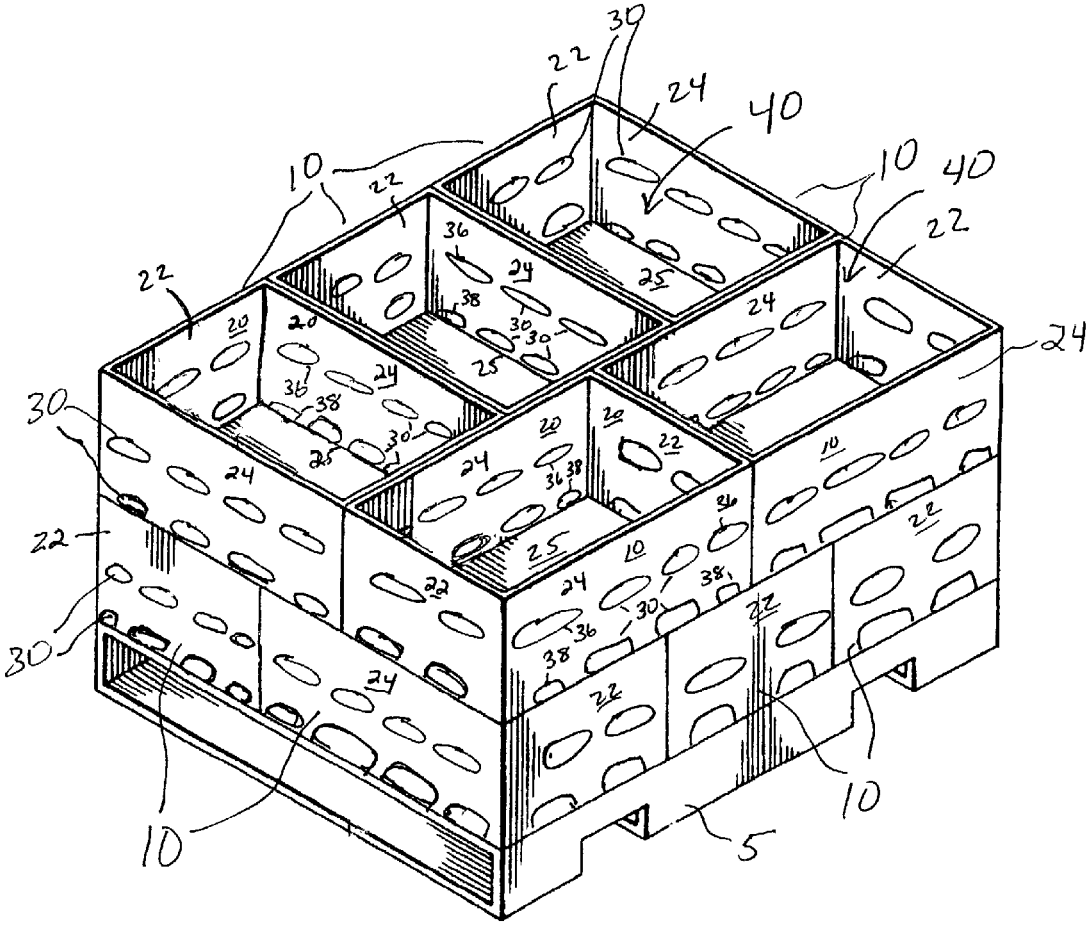
FIG. 6 is a perspective view of a plurality of ventilated shipping trays stacked on a pallet in a five-down configuration without the produce containers.
Figure 7:
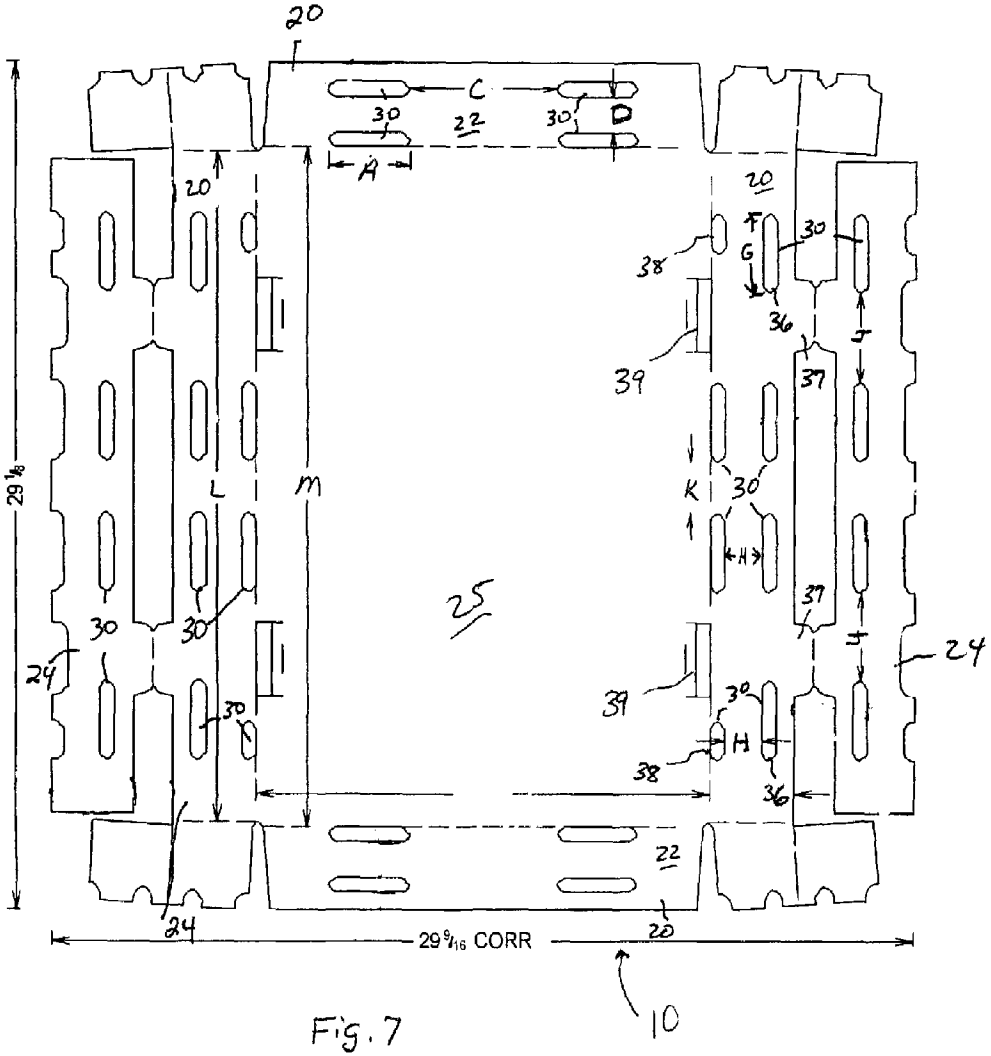
FIG. 7 is a plan view of a blank for an embodiment of the ventilated container according to the present invention.

As illustrated in FIGS. 6 and 7, each ventilated shipping tray 10 according to the present invention that receives the container 100 includes four sidewalls 20, a bottom surface 25 that extends between the sidewalls 20 and an open inner space 40. The ventilated trays 10 can be formed of any known material, such as paperboard, corrugated board, wood or plastic. The ventilated tray 10 can have a square or rectangular shape (horizontal cross section). In a preferred embodiment, such as that depicted in FIG. 6, the ventilated tray 10 has a rectangular shape. In such an embodiment, the cooling tray 10 includes first and second endwalls 22 and first and second sidewalls 24. The terms "endwall" and "sidewall" are not limiting to the position of the cooling trays 10 on the pallet 5.

Figure 8:
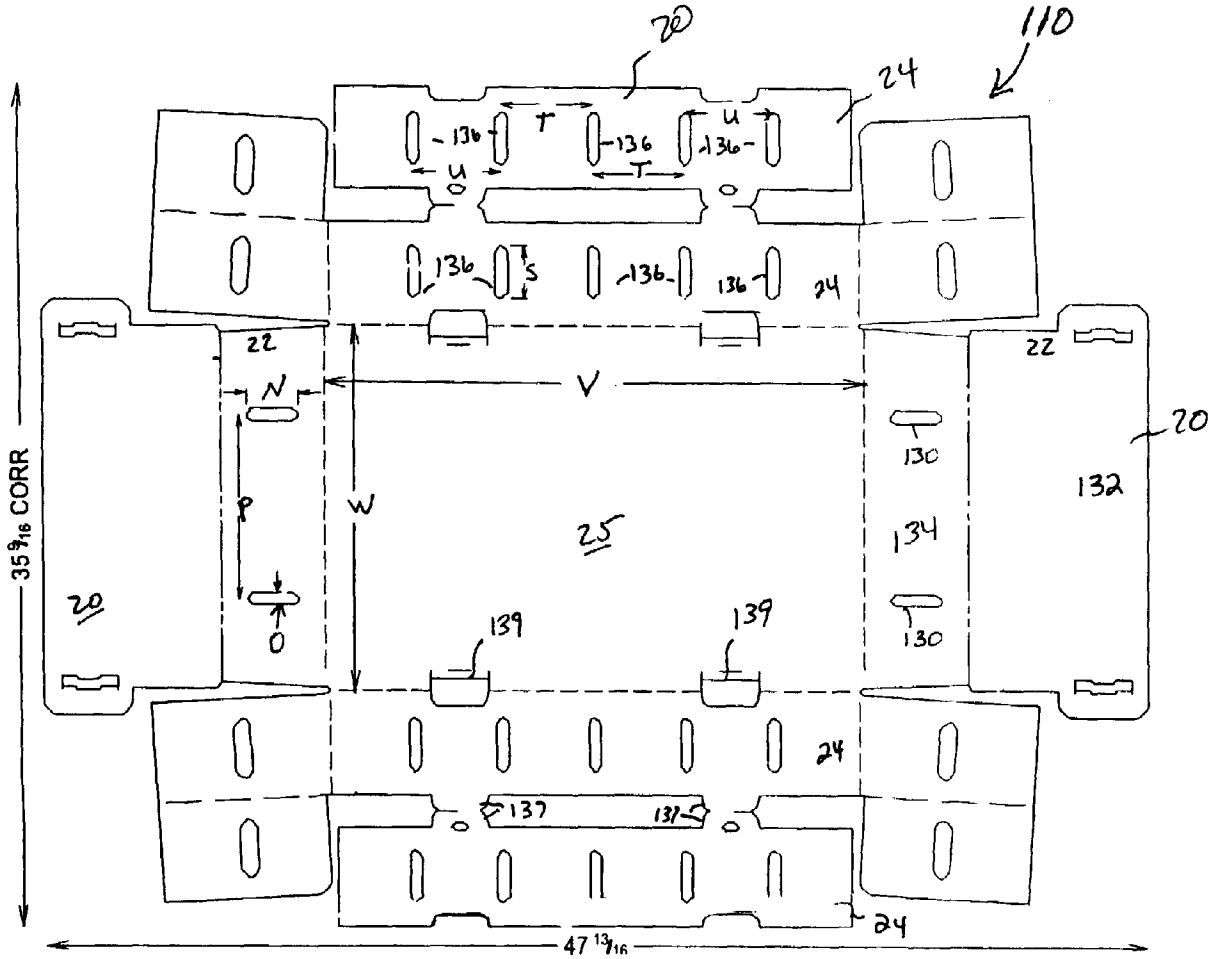
FIG. 8 is a plan view of a blank for another embodiment of the ventilated container according to the present invention.

Referring to the embodiment illustrated in FIGS. 6 and 7, the endwalls 22 and the sidewalls 24 each include a plurality of ventilation openings 30 that permit cooling fluids, such as air, to enter the tray 10 and the fluid passages in the containers 100 in order to cool the produce contained in the containers 100 as discussed below. These ventilation openings 30 are sized and arranged on the endwalls 22 and sidewalls 24 so as to align with respective fluid passages 106 and the fluid channel 109 of the carried containers 100. As a result, optimized cooling airflow will enter the ventilated trays 10 and the carried containers 100. Therefore, the size and location of the openings 30 will differ on trays 10 used to carry different sized containers 100. The size and orientation of the openings 30 will mate with the size and openings in the containers 100 so that the cooling laminar fluid flow will not be obstructed as it moves from the tray 10 into the container 100 from any one or more of the sides of the pallet. For example, it may be more preferred to use the ventilated tray 10 illustrated in FIG. 7 with containers 100 carrying fruits such as strawberries. Similarly, it may be more preferred to use the ventilated tray 110 illustrated in FIG. 8 to carry fruits or other produce such as grapes that require a taller container 100.

The endwalls 22 of the ventilated tray 10 each include an array of openings 30. The array includes two horizontal rows of openings 30 and two vertical columns 30. In a preferred embodiment, as shown in FIG. 7, the openings 30 have the general shape of an elongated oval. In this preferred embodiment, the openings 30 and endwalls 22 have the below discussed dimensions. Each opening 30 has a length A of between approximately 2.5 and 3.0 inches, preferably about 2.75 inches. Each opening 30 has a height of between about 0.25 inch and 0.75 inch, preferably about 0.5 inch. The opening 30 in each row are spaced from each other by a horizontal distance C of between about 4.75 and 5.25 inches, preferably about 5.0625 inches. The openings 30 in each column are vertically spaced from each other by a distance D of between about 1.0 and 1.50 inches, preferably about 1.25 inches. The uppermost openings 30 are spaced from an upper edge of the endwall 22 by a distance of between about 0.4 inch and 0.8 inch, preferably about 0.625 inch. The total height of each endwall 22, from the bottom surface 25 to the upper edge 29 of the endwall 22 is between about 2.5 and 3.0 inches, preferably about 2.875 inches. The total length of each endwall 22 is between about 15.4 and 15.9 inches, preferably about 15.5625 inches. The endwalls 22, like the sidewalls 24, can have any known thickness.

The sidewalls 24 each include a plurality of ventilation openings 36 that are arranged in an array having two horizontal rows and four vertical columns. The two outermost vertical columns include an upper large opening 36 having a length G of between about 2.5 and 3.0 inches, preferably about 2.75 inches, and a lower, smaller opening 38 having a length of between about 1.0 inch and 1.5 inches, preferably about 1.375 inches. A distance H of between about 1.0 and 1.5 inches, preferably about 1.25 inches vertically separates these openings 36, 38. The middle two columns include openings 36 that have a length I of between about 2.5 inches and 3.0 inches, preferably about 2.75 inches and that are spaced by the distance H. A distance J of between about 2.75 inches and 3.25 inches, preferably about 3.0 inches, horizontally separates the openings 36 of the inner two columns from the openings 36 of the outer two columns. A distance K of about 1.5 inches and 2.0 inches, preferably about 1.75 inches, horizontally separates the openings of the two middle columns. The openings 36, 38 have a height of between about 0.25 inch and 0.75 inch, preferably about 0.5 inch, and are separated from the upper edge 29 of the sidewall 24 by a distance of between about 0.4 inch and 0.8 inch, preferably about 0.625 inch. The length L of each sidewall 24 is between about 22.0 and 24.0 inches, preferably about 23.0 inches, whereas the distance M between the two endwalls 22 is between about 23.0 inches and 24.0 inches, preferably about 23.375 inches when the ventilated tray is assembled. The sidewalls 24 each have two layers, the first, outer layer has a vertical height of between about 2.5 inches and 3.25 inches, preferably about 2.875 inches. The second, inner layer, which is folded over the outer layer, has a height of between about 2.5 and 3.0 inches, preferably about 2.75 inches. Each sidewall 24 also includes protruding members 37 that extend through respective openings 39 in the bottom 25 of a tray 10 that is stacked on top of it. These protruding members 37 and openings 39 stabilized the stacks of trays 10. In one embodiment, the blank, before folding, has a length of about 29.125 inches and a width of about 29.5625 inches.

As mentioned above, FIG. 8 illustrates another embodiment of the ventilated tray for use with taller containers 100 than those used with the embodiment shown in FIGS. 6 and 7. This embodiment of the ventilated tray 110 includes sidewalls 20 having a plurality of ventilation openings for permitting cooling fluids, such as air, to enter the interior space 40 of the ventilated tray 110 and the carried containers 100 in order to cool the produce housed in the containers 100. The ventilated tray 110 is essentially the same as ventilated tray 10 except for the below discussed differences.

The endwalls 22 of the ventilated tray 110 include a first, handle section 132 and a second, ventilation section 134 in which the ventilation openings 130 are formed. The handle sections 132 have a height of between about 7.5 and 8.0 inches, preferably about 7.65625 inches. The ventilation sections of the endwalls 22 have a height of between about 4.25 and 4.75 inches, preferably about 4.5 inches and each include a pair of the openings 130. The openings 130 have the general shape of an elongated, vertically oriented oval. Each opening 130 has a height N of between about 2.0 and 2.5 inches, preferably about 2.25 inches and a width 0 of between about 0.25 inch and 0.75 inch, preferably about 0.5 inch. The center of each opening 130 is horizontally spaced from the center of an adjacent opening by a distance P of between about 7.5 and 8.0 inches, preferably about 7.8125 inches.

The sidewalls 24 of the ventilated tray 110 each include a plurality of ventilation openings 136 spaced along its length. The openings 136 have a vertical length S of between about 2.0 and 2.5 inches, preferably about 2.25 inches and a horizontal width of between about 0.25 and 0.75 inch, preferably about 0.5 inch. The center three openings 136 are spaced from each other by a distance T of about four inches. The outer openings 136 are spaced from adjacent center openings 136 by a distance U of between about 3.5 and 4.0 inches, preferably about 3.8125 inches. The sidewalls 24 are between about 4.1 and 4.6 inches tall, preferably about 4.375 inches tall. The interior of the tray 110 is between about 23.25 and 25.5 inches long V, preferably about 23.375 inch long, and between about 15.25 and 15.75 inches wide W, preferably about 15.5625 inches wide. In one embodiment, the blank from which the tray 110 is formed is about 35.5 inches wide and about 47.8 inches long. Each sidewall 24 also includes protruding members 137 that extend through respective openings 139 in the bottom 25 of the tray 110 that is stacked on top of it. These protruding members 137 and openings 139 stabilized the stacks of layered ventilation trays 110 on the pallet 5.

The discussions set forth below are applicable to all of the above-discussed embodiments of the shipping trays. However, for clarity of the explanation, the discussion will be limited to one embodiment—shipping tray 10. In a preferred embodiment, each ventilated tray 10 can carry up to eight of the one-pound produce carrying plastic containers 100, illustrated in FIGS. 2–5. The containers 100 are typically arranged in two rows of four within the ventilated trays 10 as shown in FIG. 9.

Figure 9:
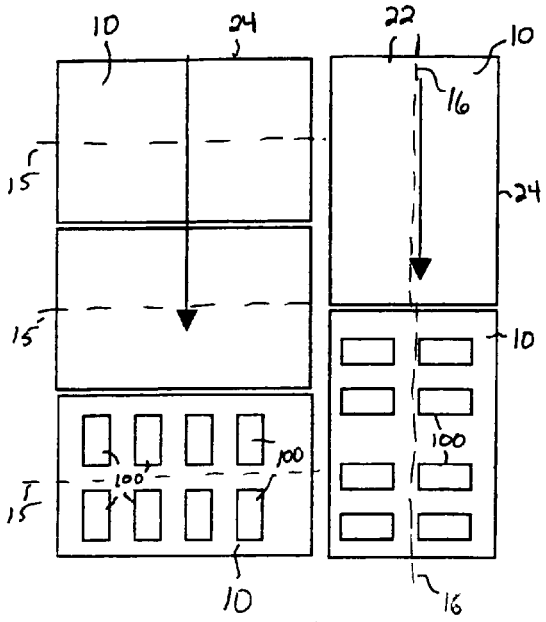
FIG. 9 is a plan view of the cooling fluid flow through the ventilated chambers arranged in a five-down configuration.
Figure 11:
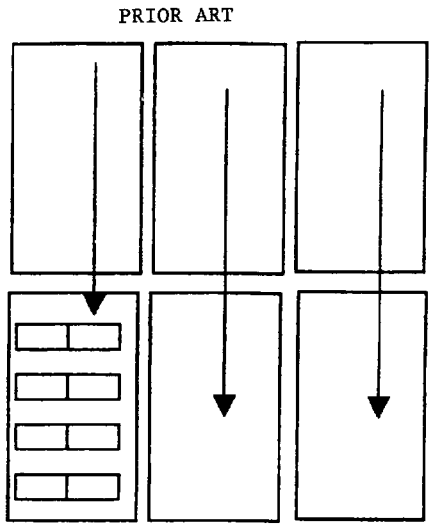
FIG. 11 is a plan view of the cooling fluid flow through conventional ventilated chambers arranged in a six-down configuration.

Five of the ventilated shipping trays 10 are then placed on an upper surface of the pallet 5 in a five down configuration as shown in FIG. 9 to form a single layer on the pallet 5. Additional layers of the ventilated trays 10 in a five down configuration are positioned on top of the layer(s) already arranged on the pallet 5 to form a stack of the ventilated trays. When the stack includes a predetermined number of layers on the pallet 5, such as eight, the stacked pallet 5 is ready for shipping.

As shown in FIG. 9, the phrase "five-down configuration" relates to a specific arrangement of ventilated trays 10 on the pallet 5. A five-down configuration includes the formation of a single layer of ventilated trays 10 on the pallet 5 using only five ventilated trays 10. In this configuration, two of the ventilated trays 11 form a row in their length direction and the remaining three ventilated trays 12 form a row in their width direction. As illustrated, the longitudinal axes 15 of the three ventilated trays 12 are parallel to each other and parallel to two sides of the pallet. The remaining two ventilated trays 11 are positioned on the pallet 5 so that their longitudinal axes 16 are aligned and parallel to each other, and perpendicular to the longitudinal axes 15 of the other three ventilated trays 12. Multiple five-down configured layers of ventilated trays 10 are stacked on top of the pallet 5 in preparation for transporting the produce to the end consumer. The number of five-down configured layers stacked on top of each other may vary on each pallet 5. However, in conventional stacking, the pallet 5 would include eight layers of ventilated trays 10 arranged in a five-down configuration.

Figure 10:
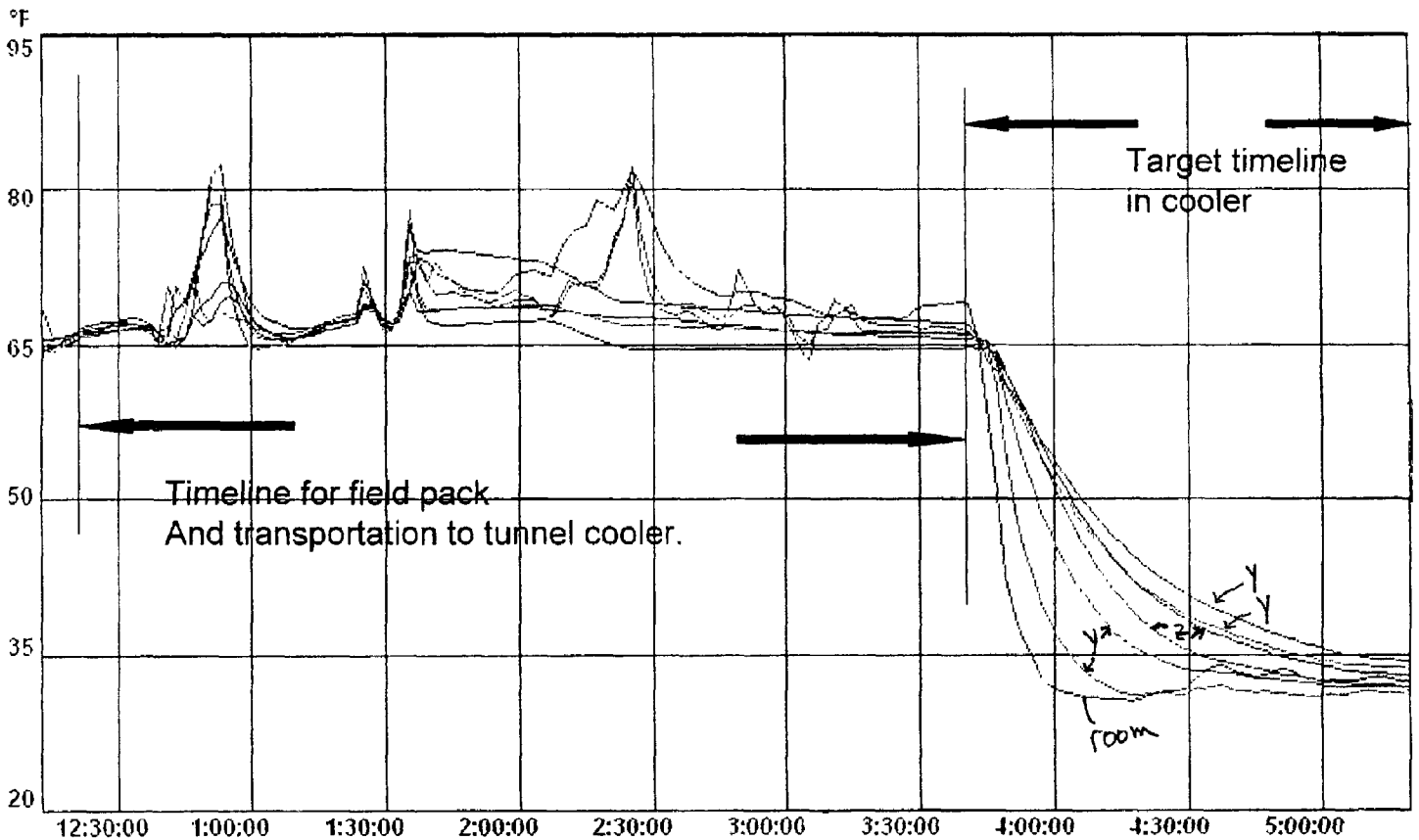
FIG. 10 is a graph illustrating the cooling rates of five-down and six-down configured trays.

After the ventilated trays 10 have been placed on their respective pallets 5, the pallets 5 are transferred to the cooling chamber 200 shown in FIG. 1 and stored in multiple rows. When positioned within the cooling chamber 200, the cooling fluid, such as air or water, is introduced into the ventilated containers 10 through the endwalls 22 of the two ventilated trays 11 and the sidewalls 24 of the remaining ventilated trays 12 (See FIG. 9). Alternatively, the pallet 5 can be arranged so that the cooling fluid enters through the endwalls of the three parallel positioned ventilated trays 12 and then through the sidewalls of the remaining two ventilated trays 11. As discussed above, the ventilated trays 10 provide a specific venting pattern that cooperates with the openings in the containers 100 to create a system that cools as rapidly as the conventional six-down configurations. The cooling rates between the five-down configuration (X) and the six-down configuration (Z) are illustrated in the graph in FIG. 10.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

We claim:

1. A shipping tray for receiving produce carrying containers, said shipping tray comprising a bottom, sidewalls and end walls extending from said bottom, each said sidewall and end wall including a plurality of ventilation openings sized and configured to be coextensive with openings in the produce carrying containers so as to allow cooling fluid to pass through said sidewalls and end walls into the containers when the containers are positioned within the shipping tray, said sidewalls each include eight of said ventilation openings comprised of a plurality of large ventilation openings and a plurality of small ventilation openings, wherein said small sidewall ventilation openings and a plurality of said large ventilation openings are positioned in a first row proximate said bottom and a plurality of said large ventilation openings are spaced from said bottom and arranged in a second row spaced from said first row.

2. The shipping tray according to claim 1 wherein said small ventilation openings have a length of less than 1.5 inches and said large ventilation openings have a length of greater than 2.5 inches.

3. The shipping tray according to claim 2 wherein the large ventilation openings spaced from said bottom are positioned at least 1.5 inches above said bottom.

4. The shipping tray according to claim 2 wherein said large ventilation openings and said small ventilation openings have a height of about 0.5 inch.

5. A shipping tray containing produce carrying containers comprising ventilation openings, said shipping tray comprising a bottom and a plurality of walls extending from said bottom, each said wall extending at an angle to an adjacent one of said walls and including a plurality of ventilation openings, said ventilation openings each being aligned and coextensive with at least one of said ventilation openings in the produce carrying containers so as to allow cooling fluid to pass through said walls and into the containers when the containers are positioned within the shipping tray, at least one of said walls including a first row of said ventilation openings wherein said ventilation openings include two openings in two of said walls and five openings in two of said walls.

6. The shipping tray according to claim 5 wherein said ventilation openings each have a length of at least 2 inches.

7. The shipping tray according to claim 6 wherein said ventilation openings have a length of less than 3 inches.

8. The shipping tray according to claim 7 wherein a plurality of said ventilation openings are spaced from said bottom; and wherein a longitudinal axis of said spaced ventilation openings extends in a direction away from said bottom.

9. A tray for use in a five down configuration on a pallet, said tray containing produce carrying containers with fluid passage openings, said tray comprising first and second walls extending at angles to each other, said first wall including a plurality of ventilation openings each being aligned and coextensive with at least one of said fluid passage openings in the produce carrying containers within said tray and said second wall including a plurality of ventilation openings each being aligned and coextensive with at least one of said fluid passage openings in the produce carrying containers so that fluid can pass through both walls of said tray and the produce carrying containers when cooling fluid is introduced into said tray through at least one of said walls, wherein at least one of said walls includes a row of said ventilation openings and said first wall comprises a sidewall and said second wall comprises an endwall; and wherein said tray includes a plurality of sidewalls and a plurality of endwalls wherein said endwalls each include four of the ventilation openings, said row of ventilation openings forms a lower row of ventilation openings, and each said ventilation opening is arranged in a respective one of an upper row and said lower row wherein said lower row of said endwall ventilation openings includes ventilation openings of different lengths.

10. The tray according to claim 9 wherein said upper row of said endwall ventilation openings is vertically spaced above the lower row by a distance of between about 1 inch and about 2 inches.

11. The tray according to claim 10 wherein said distance between said rows is about 1.25 inches.

12. A tray for use in a five down configuration on a pallet, said tray comprising sidewalls and end walls extending at angles to each other, each said sidewall having eight ventilation openings including large ventilation openings and small ventilation openings for aligning and being coextensive with respective fluid passage openings in produce carrying containers that are positionable within said tray and each said end wall including a plurality of ventilation openings for aligning and being coextensive with respective fluid passage openings in the produce carrying containers so that fluid can pass through the sidewalls and end walls of said tray and the produce carrying containers when said tray is positioned on the pallet, wherein said small sidewall ventilation openings and a plurality of said large ventilation openings are positioned in a row adjacent said bottom and a plurality of said large ventilation openings are arranged in a row spaced from said bottom.

13. The tray according to claim 12 wherein the large ventilation openings spaced from said bottom are positioned at least 1.5 inches above said bottom.

* * * * *

UNITED STATES PATENT AND TRADEMARK OFFICE

CERTIFICATE OF CORRECTION

PATENT NO. : 7,007,802 B1
APPLICATION NO. : 10/231379
DATED : March 7, 2006
INVENTOR(S) : Stephen E. Moorman and Philip W. Weideman It is certified that error appears in the above-identified patent and that said Letters Patent is hereby corrected as shown below:

COLUMN 8
Line 17, please replace "claim 2" with --claim 1--.

COLUMN 8
Line 20, please replace "claim 2" with --claim 1--.

Signed and Sealed this

First Day of August, 2006

JON W. DUDAS
*Director of the United States Patent and Trademark Office*